US009854922B1

(12) United States Patent
Schiller

(10) Patent No.: US 9,854,922 B1
(45) Date of Patent: Jan. 2, 2018

(54) ERGONOMIC MATTRESS HAVING SUPPORT SECTIONS WITH INTERNAL VARIATIONS

(71) Applicant: Stephen J. Schiller, Naples, FL (US)

(72) Inventor: Stephen J. Schiller, Naples, FL (US)

(73) Assignee: PRANASLEEP, LLC, Bonita Springs, FL (US)

( * ) Notice: Subject to any disclaimer, the term of this patent is extended or adjusted under 35 U.S.C. 154(b) by 0 days.

(21) Appl. No.: 15/409,087

(22) Filed: Jan. 18, 2017

(51) Int. Cl.
*A47C 27/15* (2006.01)
*A47C 31/12* (2006.01)
*A47C 27/14* (2006.01)

(52) U.S. Cl.
CPC ..... *A47C 31/123* (2013.01); *A47C 27/146* (2013.01); *A47C 27/15* (2013.01)

(58) Field of Classification Search
CPC ..... A47C 27/14; A47C 27/142; A47C 27/144; A47C 27/146; A47C 27/15; A47C 27/148; A47C 27/16; A47G 2009/1018; A47G 9/10
See application file for complete search history.

(56) References Cited

U.S. PATENT DOCUMENTS 3,747,916 A * 7/1973 Benson ..... A61G 13/009 5/600
3,846,857 A 11/1974 Weinstock
4,053,957 A * 10/1977 Regan ..... A47C 23/00 5/727
4,665,573 A * 5/1987 Fiore ..... A47C 27/146 5/731
5,134,735 A 8/1992 Rose
5,513,402 A * 5/1996 Schwartz ..... A47C 23/00 5/691
5,533,218 A * 7/1996 Fahy ..... A47C 27/144 5/421
5,671,492 A * 9/1997 Simon ..... A47C 27/144 5/722
6,052,851 A * 4/2000 Kohnle ..... A61G 7/05715 5/690
6,202,239 B1 3/2001 Ward et al.
6,807,698 B2 10/2004 Torbet et al.
7,065,816 B2 * 6/2006 McGettigan ..... A47C 20/025 5/727
7,356,863 B2 4/2008 Oprandi
7,386,903 B2 6/2008 Hochschild
7,536,741 B1 * 5/2009 Schultz ..... A47C 27/146 5/733
9,138,066 B1 9/2015 Goenka
9,504,336 B2 * 11/2016 Dodd ..... A47C 31/123
2003/0221262 A1 * 12/2003 Torbet ..... A47C 27/082 5/713

(Continued)

*Primary Examiner* — Eric J Kurilla
(74) *Attorney, Agent, or Firm* — Livingston Loeffler, P.A.; Edward M. Livingston; Bryan L. Loeffler

(57) ABSTRACT

An ergonomic mattress (1) having one or more support sections with varying heights and/or thicknesses that create one or more voids (13) within a body (5) of the mattress. The varying heights, thicknesses and/or voids are achieved by eliminating one or more layers of support material from the body of the mattress in a desired area and/or using a shorter and/or thicker pieces of support material in a desired area in comparison to the other areas of the mattress to create concave indentations (17) on a top surface (6) of the mattress.

10 Claims, 2 Drawing Sheets

(56) References Cited

U.S. PATENT DOCUMENTS

| | | | | |
|---|---|---|---|---|
| 2004/0074007 | A1* | 4/2004 | Gladney | A47C 27/20 5/727 |
| 2005/0193497 | A1* | 9/2005 | Baker | A47C 27/001 5/721 |
| 2010/0058541 | A1* | 3/2010 | Kemper | A47C 27/001 5/701 |
| 2011/0099722 | A1* | 5/2011 | Moret | A47C 27/056 5/701 |
| 2012/0124753 | A1 | 3/2012 | Lee | |
| 2013/0081208 | A1* | 4/2013 | Dyevich | A61G 7/05715 5/727 |
| 2013/0145555 | A1* | 6/2013 | Hargreaves | A47C 27/144 5/655 |
| 2014/0259429 | A1* | 9/2014 | Clayton | A47C 27/15 5/691 |
| 2015/0015402 | A1* | 1/2015 | Boyd | A47C 27/085 340/626 |
| 2015/0250327 | A1* | 9/2015 | Boyd | A47C 27/085 705/26.7 |
| 2015/0265063 | A1* | 9/2015 | Cappadona | A47C 27/002 5/698 |
| 2015/0305514 | A1* | 10/2015 | Kulju | A47C 27/05 5/727 |
| 2016/0174726 | A1* | 6/2016 | Smith | A47C 27/18 5/735 |

* cited by examiner

ERGONOMIC MATTRESS HAVING SUPPORT SECTIONS WITH INTERNAL VARIATIONS

FIELD OF THE INVENTION

This invention relates to mattresses and more particularly, a mattress wherein the main body is made up of multiple layers of support material having varying heights, thicknesses and/or voids to provide a contoured upper surface.

BACKGROUND OF THE INVENTION

Chronic pain can sometimes be linked to the type of mattress an individual sleeps on. Sleeping on a conventional mattress can result in physical ailments, such as shoulder pain, hip pain, leg pain and so forth.

These ailments are typically caused by undue pressure on the hips and shoulders caused by a mattress having a singular evenly flat upper surface that does not allow the individual's shoulders and/or hips to sink into proper alignment with the spine, especially when an individual is sleeping on his or her side. This is due to the profile of the human skeleton wherein the top of the shoulder and the top of the femur protrude furthest from the center of the body or spine. With a flat conventional mattress, much of the body's weight is absorbed in these two areas.

Previous attempts to solve this problem included the creation of mattresses having "zones" or areas of material having varying densities. However, the thickness or height of these mattresses always remained the same meaning the individual is still sleeping on a flat surface that allows an individual's torso to sink below his or her shoulder and hips, thereby causing misalignment of the spine and joints.

Therefore, a need exists for a method and system for an ergonomic mattress made up of multiple layers of material having varying heights, thicknesses and/or voids that conform to an individual's body and properly disperse pressure across the individual's body.

SUMMARY OF THE INVENTION

The primary object of the present invention is to provide an ergonomic mattress made up of multiple layers of material having varying heights, thicknesses and/or voids that conform to an individual's body and properly disperse pressure across the individual's body.

The present invention fulfills the above and other objects by providing an ergonomic mattress having one or more support sections with varying heights, thicknesses and/or voids. The varying heights, thicknesses and/or voids are achieved by eliminating one or more layers of support material from the body of the mattress in a desired area and/or using a shorter and/or thicker pieces of support material in a desired area in comparison to the other areas of the mattress to create concave indentations on a top surface of the mattress.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
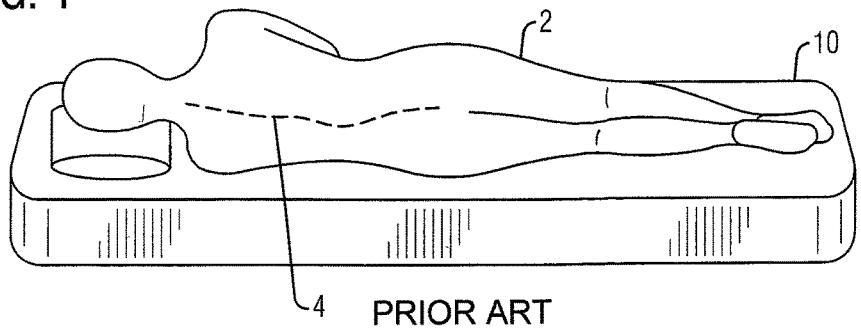
FIG. 1 is an exemplary side view of an individual lying on a conventional mattress wherein the individual's spine and joints are misaligned.

For purposes of describing the preferred embodiment, the terminology used in reference to the numbered accessories in the drawings is as follows:

1. ergonomic mattress, generally
2. individual
3. conventional mattress
4. spine
5. mattress body
6. top surface of mattress body
7. bottom surface of mattress body
8. head support section
9. shoulder support section
10. torso support section
11. hip support section
12. leg support section
13. void
14. bottom layer of support material
15. middle layer of support material
16. top layer of support material
17. concave indentation
18. intermediate support layer With reference to FIG. 1, an exemplary side view of an individual 2 lying on a conventional mattress 3 wherein the individual's spine 4 and joints are misaligned is illustrated. Shoulder, back and hip pain are typically caused by undue pressure on the hips and shoulders while sleeping on a conventional mattresses 3 having a flat surface that does not allow the shoulders and/or hips to sink into the conventional mattress 3, especially when the individual 2 is sleeping on his or her side. This is due to the profile of the human skeleton wherein the top of the shoulder and the top of the femur protrude furthest from the center of the body or spine 4. With a flat conventional mattress 3, much of the body's weight is absorbed in these two areas, thereby pushing the shoulders and hips upward out of their natural position and curving the spine 3, as illustrated herein.

Figure 2:
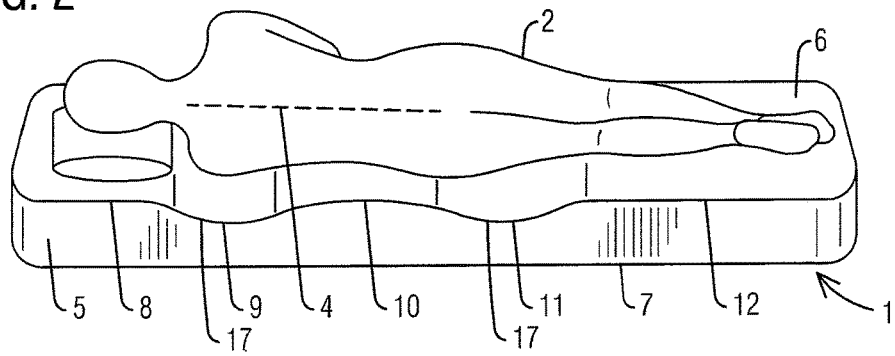
FIG. 2 is an exemplary side view of an individual lying on an ergonomic mattress of the present invention wherein the individual's spine and joints are properly aligned.
Figure 3:
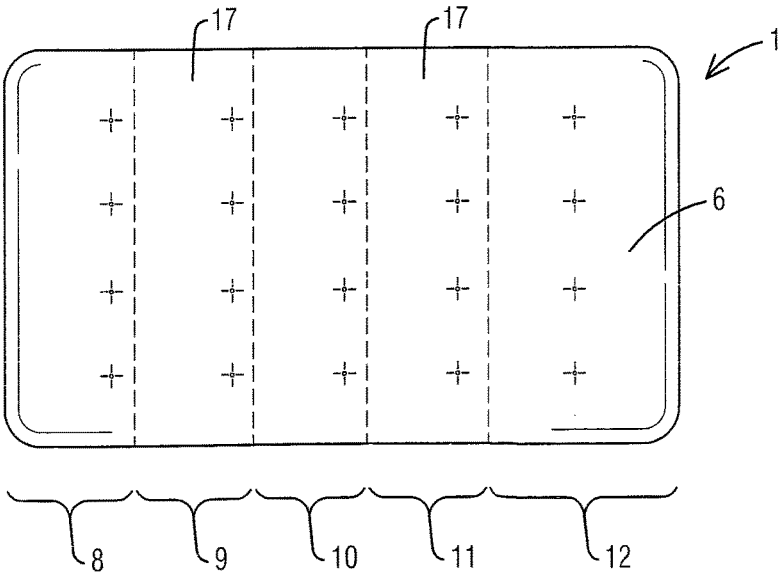
FIG. 3 is a top plan view of a mattress of the present invention showing the various support sections.

With reference to FIGS. 2 and 3, an exemplary side view of an individual 2 lying on an ergonomic mattress 1 of the present invention wherein the individual's spine 3 and joints are properly aligned is illustrated. The ergonomic mattress 1 of the present invention provides a mattress body 5 having a top surface 6, a bottom surface 7 and sections of varying thickness. For example, as illustrated in FIG. 3, the ergonomic mattress 1 comprises five support sections: a head support section 8, a shoulder support section 9, a torso support section 10, a hip support section 11 and a leg support section 12. The shoulder support section 9 and hip support section 11 each have heights measured from the bottom surface 7 to the top surface 6 of the mattress body 5 that are less than heights of the head support section 8, torso support section 10 and leg support section 12. Therefore, the individual's shoulders and hips are allowed to rest below a horizontal plane on which the individual's head, torso and legs are resting, thereby creating proper alignment of the spine 3 and joints, as illustrated in FIG. 2. The shorter heights of the shoulder support section 9 and the hip support section 11 are created using varying thickness of support material and/or eliminating sections of support material to creating voids 13 in the mattress body 5, as illustrated in FIGS. 4 and 5.

Figure 4:
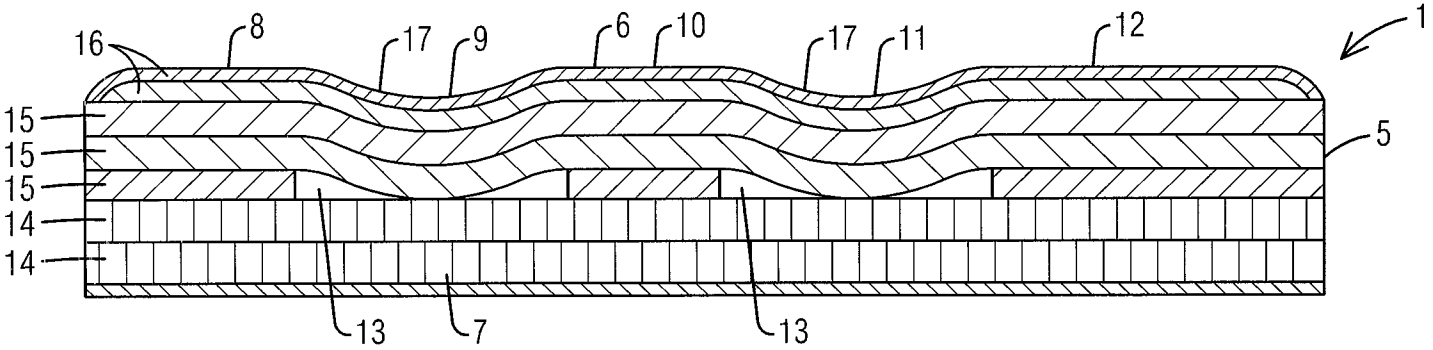
FIG. 4 is a side elevation cross-sectional view of a mattress of the present invention having voids located within the mattress body created by eliminating sections of one or more support layers.

With reference to FIG. 4, a side elevation cross-sectional view of an ergonomic mattress 1 of the present invention having voids 13 located within the mattress body 5 created by eliminating sections of one or more support layers is illustrated. The ergonomic mattress 1 of the present invention comprises a mattress body 5 having a top surface 6, a bottom surface 7, at least one bottom layer of support material 14, at least one middle layer of support material 15 and at least one top layer of support material 16. Said support material may comprise foam, springs, micro-coils, cotton batting, and/or any equivalent material. As illustrated herein, a middle layer of support material 15 has voids created 13 by removing sections of the middle layer of support material 15. Top layers of support material 16 then dip into the voids 13 to created concave indentations 17 on the top surface 6 of the mattress body 5. The concave indentations 17 are positioned in a manner that creates a plurality of support sections on the ergonomic mattress 1, as illustrated in FIG. 3. Voids 13 may be located within a bottom layer of support material 14, a middle layer of support material 15 and/or a top layer of support material 16.

As illustrated in FIG. 3, the plurality of support sections comprise a head support section 8 located adjacent to a top edge of the mattress, a shoulder support section 9 (wherein a concave indentation 17 is located) located adjacent to the head support section 8, a torso support section 10 located adjacent to the shoulder support section 9, a hip support section 11 (wherein a concave indentation 17 is located) located adjacent to the torso support section 10, and a leg support section 12 located adjacent to the hip support section 11.

Figure 5:
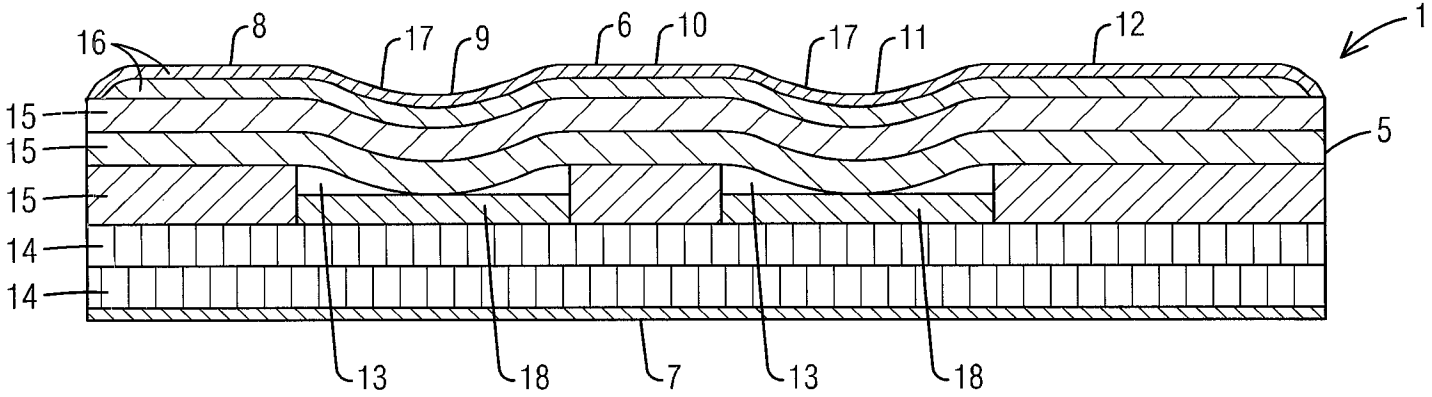
FIG. 5 is a side elevation cross-sectional view of an ergonomic mattress of the present invention having voids located within the mattress body created by eliminating sections of one or more support layers and using intermediate support layers of varying thickness within the created void to adjust the depth of the void.

With reference to FIG. 5, a side elevation cross-sectional view of an ergonomic mattress 1 of the present invention having voids 13 located within the mattress body 5 created by eliminating sections of one or more support layers and using intermediate support layers of varying thickness within the created void to adjust the depth of the void 13 is illustrated. The ergonomic mattress 1 of the present invention comprises a mattress body 5 having a top surface 6, a bottom surface 7, at least one bottom layer of support material 14, at least one middle layer of support material 15 and at least one top layer of support material 16. Said support material may comprise foam, springs, micro-coils, cotton batting, and/or any equivalent material. As illustrated herein, a middle layer of support material 15 has voids created 13 by removing sections of the middle layer of support material 15. The depth of the voids 13 is then adjusted by placing one or more intermediate support layers 18 within the voids 13. Top layers of support material 16 then dip into the voids 13 to created concave indentations 17 on the top surface 6 of the mattress body 5. The concave indentations 17 are positioned in a manner that creates a plurality of support sections on the ergonomic mattress 1, as illustrated in FIG. 3.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. An ergonomic mattress comprising:

a mattress body having a top surface, a bottom surface, at least one bottom layer of support material, at least one middle layer of support material and at least one top layer of support material;

at least one void located within the mattress body; and upon final assembly and when the mattress body is not in use, said at least one void creates at least one concave indentation on the top surface of the mattress body and the at least one middle layer sinks into the at least one void.

2. The ergonomic mattress of claim 1 wherein:

said mattress body further comprises a head support section located adjacent to a top edge of the mattress, a shoulder support section located adjacent to the head support section, a torso support section located adjacent to the shoulder support section, a hip support section located adjacent to the torso support section, and a leg support section located adjacent to the hip support section.

3. The ergonomic mattress of claim 2 wherein:

said at least one concave indentation is located on the shoulder support section.

4. The ergonomic mattress of claim 2 wherein:

said at least one concave indentation is located on the hip support section.

5. The ergonomic mattress of claim 1 further comprising:

an intermediate support layer located within the at least one void.

6. An ergonomic mattress comprising:

a mattress body having a top surface, a bottom surface, at least one bottom layer of support material, at least one middle layer of support material and at least one top layer of support material;

at least one void located within the mattress body extending between sides of the mattress; and upon final assembly and when the mattress body is not in use, said at least one void creates at least one concave indentation on the top surface of the mattress body extending between sides of the mattress and the at least one middle layer sinks into the at least one void.

7. The ergonomic mattress of claim 6 wherein:

said mattress body further comprises a head support section located adjacent to a top edge of the mattress, a shoulder support section located adjacent to the head support section, a torso support section located adjacent to the shoulder support section, a hip support section located adjacent to the torso support section, and a leg support section located adjacent to the hip support section.

8. The ergonomic mattress of claim 6 further comprising:

an intermediate support layer located within the at least one void.

9. An ergonomic mattress comprising:

a mattress body having a top surface, a bottom surface, at least one bottom layer of support material, at least one middle layer of support material and at least one top layer of support material;

at least one void located within the mattress body extending between sides of the mattress;

upon final assembly and when the mattress body is not in use, said at least one void creates at least one concave indentation on the top surface of the mattress body extending between sides of the mattress and the at least one middle layer sinks into the at least one void; and a head support section located adjacent to a top edge of the mattress, a shoulder support section located adjacent to the head support section created by said at least one void, a torso support section located adjacent to the shoulder support section, a hip support section located adjacent to the torso support section, and a leg support section located adjacent to the hip support section.

10. The ergonomic mattress of claim 9 further comprising:

an intermediate support layer located within the at least one void.

* * * * *